US007926917B2

(12) United States Patent
Tsuchii et al.

(10) Patent No.: US 7,926,917 B2
(45) Date of Patent: Apr. 19, 2011

(54) LIQUID RECORDING HEAD

(75) Inventors: Ken Tsuchii, Sagamihara (JP); Michinari Mizutani, Kawasaki (JP)

(73) Assignee: Canon Kabushiki Kaisha., Tokyo (JP)

( * ) Notice: Subject to any disclaimer, the term of this patent is extended or adjusted under 35 U.S.C. 154(b) by 592 days.

(21) Appl. No.: 11/946,508

(22) Filed: Nov. 28, 2007

(65) Prior Publication Data

US 2008/0136872 A1 Jun. 12, 2008

(30) Foreign Application Priority Data

Dec. 6, 2006 (JP) ..... 2006-329379

(51) Int. Cl.
*B41J 2/05* (2006.01)

(52) U.S. Cl. ..... 347/65

(58) Field of Classification Search ..... 347/65
See application file for complete search history.

(56) References Cited

U.S. PATENT DOCUMENTS

| | | | |
|---|---|---|---|
| 6,162,589 | A | 12/2000 | Chen et al. |
| 6,652,079 | B2 | 11/2003 | Tsuchii et al. |
| 6,830,317 | B2 | 12/2004 | Tsuchii et al. |
| 2002/0063752 | A1 | 5/2002 | Clark |
| 2007/0035580 | A1 | 2/2007 | Ide et al. |
| 2007/0206065 | A1 | 9/2007 | Tomizawa et al. |
| 2008/0055368 | A1 | 3/2008 | Oikawa et al. |
| 2008/0143786 | A1 | 6/2008 | Oikawa |

FOREIGN PATENT DOCUMENTS

| | | |
|---|---|---|
| CN | 1453133 | 11/2003 |
| EP | 1 186 414 | 3/2002 |
| JP | 2005-305828 | 11/2005 |
| RU | 2 221 701 | 1/2004 |
| WO | 2006/051762 | 5/2006 |

*Primary Examiner* — K. Feggins
*Assistant Examiner* — Lisa M Solomon
(74) *Attorney, Agent, or Firm* — Fitzpatrick, Cella, Harper & Scinto

(57) ABSTRACT

A liquid recording head for effecting recording by ejecting droplets from a plurality of ejection outlets formed on a substrate is provided. The liquid recording head includes a plurality of large droplet ejection outlets each having a relatively large ejection amount, a plurality of small droplet ejection outlets each having a relatively small ejection amount, energy generating elements for generating energy for ejecting the droplets from the plurality of large droplet ejection outlets and the plurality of small droplet ejection outlets, a liquid chamber for retaining liquid to be ejected from the plurality of large droplet ejection outlets or the plurality of small droplet ejection outlets, at least two first flow passages for establishing communication between the liquid chamber and one of the large droplet ejection outlets, and second flow passages for establishing communication between the liquid chamber and the small droplet ejection outlets.

1 Claim, 9 Drawing Sheets

LIQUID RECORDING HEAD

FIELD OF THE INVENTION AND RELATED ART

The present invention relates to a liquid recording head.

FIGS. 10 to 13 show conventional ink jet recording heads described in U.S. Pat. No. 6,830,317. In the recording heads shown in these figures, a plurality of large droplet ejection outlets 100 having a relatively large ejection amount and a plurality of small droplet ejection outlets 101 having a relatively small ejection amount are formed on the same substrate. Further, a common liquid chamber 102 common to all the ejection outlets is provided. The plurality of large droplet ejection outlets 100 and the common liquid chamber 102 establish one-to-one communication through a large droplet flow passage 103 provided for each large droplet ejection outlet 100. On the other hand, the plurality of small droplet ejection outlets 101 and the common liquid chamber 102 establish one-to-one communication through a small droplet flow passage 104 provided for each small droplet ejection outlet 101. In the large droplet flow passage 103, a large droplet heater 105 is provided and generates heat to generate a bubble in a liquid within the large droplet flow passage 103 and by a pressure during the bubble generation, a droplet (ink droplet) is ejected from a corresponding large droplet ejection outlet 100. Further, in the small droplet flow passage 104, a small droplet heater 106 is provided and generates heat to generate a bubble in a liquid within the small droplet flow passage 104 and by a pressure during the bubble generation, an ink droplet is ejected from a corresponding small droplet ejection outlet 101.

Further, the recording heads shown in FIGS. 10 and 11 have a commonality in that the large droplet ejection outlets 100 are arranged in a line at one side of the common liquid chamber 102 and the small droplet ejection outlets 101 are arranged in a line at the other side of the common liquid chamber 102. However, the recording head shown in FIG. 10 has a uniform cross-sectional shape of the small droplet flow passage 104, whereas the recording head shown in FIG. 11 has a partly narrow (constricted) cross-sectional shape of the small droplet flow passage 104, thus resulting in a large flow resistance.

Further, the recording heads shown in FIGS. 12 and 13 have a commonality in that the large droplet ejection outlets 100 and the small droplet ejection outlets 101 are arranged alternately at both sides of the common liquid chamber 102. However, the recording head shown in FIG. 12 has a uniform cross-sectional shape of the small droplet flow passage 104, whereas the recording head shown in FIG. 13 has a partly narrow (constricted) cross-sectional shape of the small droplet flow passage 104, thus resulting in a large flow resistance.

Even in any of the recording heads shown in FIGS. 10 to 13, dimensions of the small droplet ejection outlets 101 and the small droplet heater 106 are smaller than dimensions of the large droplet ejection outlets 100 and the large droplet heater 105. However, a distance (OH) from the surface of the substrate to the ejection outlets and a height (h) of the flow passages are identical with respect to not only the small droplet ejection outlets 101 but also the large droplet ejection outlets 100.

According to the above-described constitutions, on the same substrate, the large droplets and the small droplet ejection outlets can be formed simultaneously by the same forming process, so that it is possible to produce a high-performance recording head capable of compatibly realizing a high speed and a high image quality in a simple step.

However, the conventional recording heads are accompanied with the following problems (A) and (B).

<Problem (A)>

When a difference between an amount of ejection (ejection amount) of the small droplet ejection outlet and an ejection outlet of the large droplet ejection outlet is increased, it is difficult to compatibly realize ejection performances of both ejection outlets on condition that the distance (OH) from the substrate surface to the ejection outlet and the flow passage height (h) are identical with respect to both of the small droplet ejection outlet and the large droplet ejection outlet. Specifically, in the case where the small droplet ejection amount is approximately 2-3 pl (picoliters) and the large droplet ejection amount is approximately 5-6 pl, the performances of the both ejection outlets are sufficiently realized compatibly when the distance (OH) nearly equals to 25 μm and the flow passage height (h) nearly equals to 14 μm. However, when the small droplet ejection amount is less than 2 pl, a difference between values of (OH) and (h) capable of providing a proper characteristic with respect to the large droplet ejection outlet and those with respect to the small droplet ejection outlet is increased, so that the performances of the both ejection outlets cannot be readily realized compatibly.

Particularly, in a recording head of a BTJ (bubble through jet) type wherein a bubble communicates with ambient air, a bubble in the small droplet ejection outlet is less liable to communicate with the ambient air, so as to make an ejection state unstable, so that the print is liable to be disturbed.

In order to eliminate this problem, a scale of a pressure chamber of the small droplet is required to be rightsized depending on a scale in a process from bubble growth to droplet formation. Specifically, a small distance (OH) is an effective measure. However, in order to keep the performance of the small droplet ejection outlet at a proper level, when the distance (OH) is simply decreased, the following new problems (1) and (2) arise in turn.

(1) In order to maintain a strength of an orifice plate forming the ejection outlets and the flow passages, when the distance (OH) is decreased without changing a thickness of the plate, the flow passage height (h) is decreased, with the result that the flow resistance is increased. As a result, an ink refilling time from current ink droplet ejection to subsequent ink droplet ejection is increased, so that an upper limit of an ejection frequency is lowered, thus resulting in a low throughput. The ink droplet ejected from the large droplet ejection outlet is used for printing at a high density portion of a print, so that this problem is particularly noticeable.

(2) At the large droplet ejection outlet of the BTJ type recording head, the bubble is liable to communicate with the ambient air, so that the droplet forming process is placed in a state in which it is readily influenced by asymmetry with respect to a flow passage. For this reason, trailing of the ejected ink droplet occurs at a portion toward the common liquid chamber, so that the trailing portion is liable to interfere with an edge of the ejection outlet. As a result, a dew-like ink is liable to be deposited around the ejection outlet edge. When the dew-like ink retained around the ejection outlet edge interferes with the ink droplet to be ejected from the ejection outlet, an ejection direction of the ink droplet is deviated from a predetermined direction or a main droplet is not normally formed, so that a state in which normal dot printing cannot be effected is brought about.

<Problem (B)>

In the constitutions shown in FIGS. 12 and 13, i.e., such a constitution that the large droplet ejection outlets and the small droplet ejection outlets are alternately arranged at both sides of the common liquid chamber, bubble generation for ejecting the ink droplet from a large droplet ejection outlet affects an adjacent small droplet ejection outlet. As a result, a meniscus at the small droplet ejection outlet is vibrated, so that ejection from the small droplet ejection outlet is liable to be disturbed.

SUMMARY OF THE INVENTION

A principal object of the present invention is to provide an ink jet recording head capable of compatibly realizing both of performances of ejection from a small droplet ejection outlet and a large droplet ejection outlet in a proper state even when a difference in ejection amount between the small droplet ejection outlet and the large droplet ejection outlet is increased.

Another object of the present invention is to provide an ink jet recording head capable of retaining a normal ejection state by keeping a meniscus vibration of a small droplet at a proper level even in a constitution in which small droplet ejection outlets and large droplet ejection outlets are alternately arranged at both sides of a common liquid chamber.

According to an aspect of the present invention, there is provided a liquid recording head for effecting recording by ejecting droplets from a plurality of ejection outlets formed on a substrate, the liquid recording head comprising:

a plurality of first ejection outlets each for ejecting a droplet in a relatively large ejection amount;

a plurality of second ejection outlets each for ejecting a droplet in a relatively small ejection amount;

energy generating elements for generating energy for ejecting the droplets from the plurality of first ejection outlets and the plurality of second ejection outlets;

a liquid chamber for retaining liquid to be ejected from the plurality of first ejection outlets or the plurality of second ejection outlets;

at least two first flow passages for establishing communication between the liquid chamber and each of first ejection outlets; and a second flow passage for establishing communication between the liquid chamber and each of second ejection outlets.

According to another aspect of the present invention, there is provided a liquid recording head for effecting recording by ejecting droplets from a plurality of ejection outlets formed on a substrate, the liquid recording head comprising:

a plurality of first ejection outlets each for ejecting a droplet in a relatively large ejection amount;

a plurality of second ejection outlets each for ejecting a droplet in a relatively small ejection amount;

energy generating elements for generating energy for ejecting the droplets from the plurality of first ejection outlets and the plurality of second ejection outlets;

a liquid chamber for retaining liquid to be ejected from the plurality of first ejection outlets or the plurality of second ejection outlets;

a first flow passage for establishing communication between the liquid chamber and each of first ejection outlets; and a second flow passage for establishing communication between the liquid chamber and each of second ejection outlets;

wherein the first flow passages for different ones of the ejection outlets are connected with each other at a side remote from the liquid chamber.

In this case, adjacent ones of first flow passages may preferably be connected with each other at a side remote from the liquid chamber.

According to a further aspect of the present invention, there is provided a liquid recording head for effecting recording by ejecting droplets from a plurality of ejection outlets formed on a substrate, the liquid recording head comprising:

a plurality of first ejection outlets each for ejecting a droplet in a relatively large ejection amount;

a plurality of second ejection outlets each for ejecting a droplet in a relatively small ejection amount;

energy generating elements for generating energy for ejecting the droplets from the plurality of first ejection outlets and the plurality of second ejection outlets;

a liquid chamber for retaining liquid to be ejected from the plurality of first ejection outlets or the plurality of second ejection outlets;

a first flow passage for establishing communication between the liquid chamber and each of first ejection outlets; and a second flow passage for establishing communication between the liquid chamber and each of second ejection outlets;

wherein a pair of the first flow passages is symmetrically provided with respect to each of the plurality of first ejection outlets, one of the pair of the first flow passages and the second flow passage being connected with the same liquid chamber and the other one of the pair of the first flow passages being connected with a liquid chamber different from the same liquid chamber.

According to the present invention, it is possible to compatibly realize both of performances of ejection from a small droplet ejection outlet and a large droplet ejection outlet in a proper state even when a difference in ejection amount between the small droplet ejection outlet and the large droplet ejection outlet is increased. Further, it is possible to realize simply and inexpensively an ink jet recording head achieving the above effect with accuracy. Further, according to the present invention, it is possible to provide an ink jet recording head capable of retaining a normal ejection state by keeping a meniscus vibration of a small droplet at a proper level even in a constitution in which small droplet ejection outlets and large droplet ejection outlets are alternately arranged at both sides of a common liquid chamber.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 10(*b*), 11(*b*), 12(*b*) and 13(*b*) are schematic sectional views taken along A-A' line indicated in FIG. 10(*a*), A-A' line indicated in FIG. 11(*a*), C-C' line indicated in FIG. 12(*b*), and C-C' line indicated in FIG. 13(*b*), respectively.

DETAILED DESCRIPTION OF THE PREFERRED EMBODIMENTS

Embodiment 1

Figure 1:
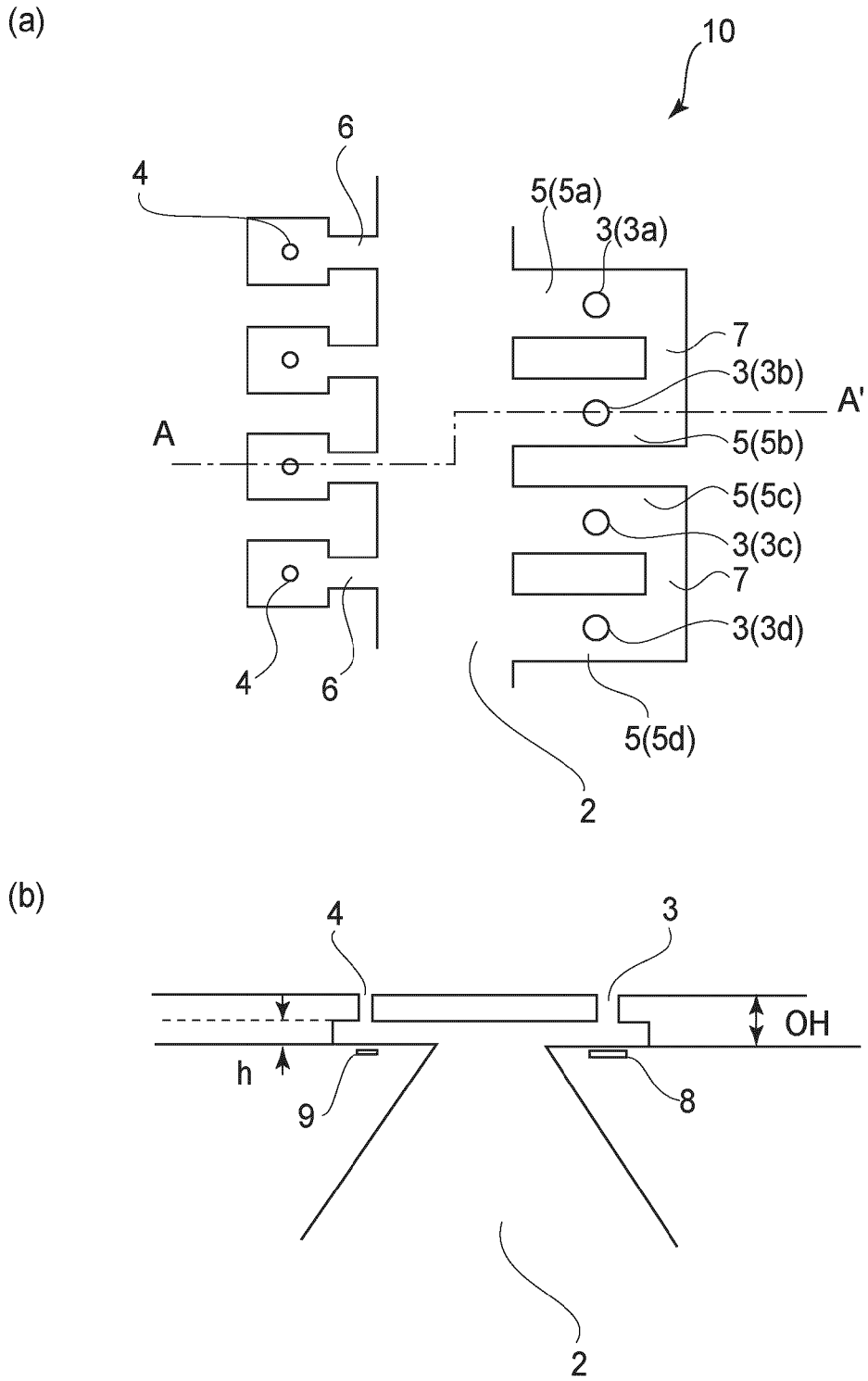
FIG. 1(*a*) is a schematic plan view showing an embodiment of the liquid recording head (ink jet recording head) according to the present invention and FIG. 1(*b*) is a schematic sectional view taken along A-A' line indicated in FIG. 1(*a*).

Hereinbelow, an embodiment of the liquid recording head (ink jet recording head) of the present invention will be described. FIG. 1(*a*) is a partially enlarged schematic plan view showing ejection outlets, flow passages and a common liquid chamber in an ink jet recording head 10 in this embodiment. FIG. 1(*b*) is a schematic sectional view taken along A-A' line indicated in FIG. 1(*a*).

As shown in FIG. 1(*a*), in the recording head 10 in this embodiment, a plurality of large droplet ejection outlets 3 (3*a* to 3*d*) is arranged in a line at one side of a common liquid chamber 2 in a longitudinal direction of the common liquid chamber 2 and a plurality of small droplet ejection outlets 4 is arranged in a line at the other side of the common liquid chamber 2 in the longitudinal direction. The large droplet ejection outlets 3 (3*a* to 3*d*) communicate with the common liquid chamber 2 through large droplet flow passages 5 (5*a* to 5*d*), respectively. Each small droplet ejection outlet 4 communicates with the common liquid chamber 2 through an associated small droplet flow passage 6.

Further, the large droplet flow passage 5*a* causing the large droplet ejection outlet 3*a* to communicate with the common liquid chamber 2 and the large droplet flow passage 5*b* causing the large droplet 3*b* to communicate with the common liquid chamber 2 are connected with each other by a sub-flow passage 7. Similarly, the large droplet flow passage 5*c* causing the large droplet ejection outlet 3*c* to communicate with the common liquid chamber 2 and the large droplet flow passage 5*d* causing the large droplet ejection outlet 3*d* to communicate with the common liquid chamber 2 are connected with each other by another sub-flow passage 7. That is, with respect to the large droplet ejection outlet 3*a*, in addition to the large droplet flow passage 5*a*, the large droplet flow passage 5*b* and the sub-flow passage 7 function as a flow passage for supplying ink. Further, also with respect to the large droplet ejection outlet 3*b*, in addition to the large droplet flow passage 5*b*, the large droplet flow passage 5*a* and the sub-flow passage 7 function as the flow passage for supplying the ink. The above-described structure is true for other large droplet flow passages including those which are not shown in FIG. 1(*a*). As a result, a flow resistance of a flow passage from the common liquid chamber to each large droplet ejection outlet 3 is remarkably reduced compared with a conventional constitution in which a single flow passage is provided to each ejection outlet.

By the above described constitution, it is possible to keep the flow resistance of the flow passage from the common liquid chamber to each large droplet ejection outlet 3 within a predetermined range even when a distance (OH) and a height (h) are decreased as shown in FIG. 1(*b*).

Therefore, according to the recording head 10 in this embodiment, the flow resistance with respect to the large droplet ejection outlet 3 can be suppressed at a low level and kept within the predetermined level even when the distance (OH) is decreased in order to properly retain an ejection performance of the small droplet ejection outlet 4 while further decreasing an ejection amount of the small droplet ejection outlet 4. As a result, refilling time can be kept in a short state, so that an upper limit of an ejection frequency can be kept at a high level and thus it is possible to maintain a high throughput.

In the conventional constitution in which the single ink flow passage is provided to each large droplet ejection outlet, the ink flow passage is placed in a blockage state on a rear side of the ink flow passage (at a side opposite (remote) from the common liquid chamber side), so that asymmetry of the ink flow passage with respect to the flow passage direction is strongly exhibited. On the other hand, in the recording head in this embodiment, the ink flow passage (the large droplet flow passage 5) is connected with its adjacent large droplet flow passage 5 at the rear side thereof, so that each of the large droplet flow passages 5 is not placed in the blockage state and has good symmetry. For this reason, even when the distance (OH) is further decreased, symmetry of the flow passage for the large droplet ejection outlet 3 with respect to the flow passage direction can be kept well. Accordingly, the trailing of the ejected droplet does not occur at the portion toward the common liquid chamber 2 in an asymmetrical manner, thus being prevented from contacting the large droplet ejection outlet 3, so that the dew-like ink cannot be deposited around a portion close to the ejection outlet 3. As a result, an occurrence of inconveniences such that the ejection direction of the ink droplet is deviated from a predetermined direction and that a main droplet cannot be formed normally to fail in normal dot printing can be obviated.

An ejection type of the ink droplet from the large droplet ejection outlet 3 connected as described above is roughly classified into the following types (a) and (b). Here, the ejection type corresponds to a drive type of an ejection energy generating means (e.g., a heater) corresponding to each of the large droplet ejection outlets 3.

(a) After an ink droplet is ejected from one of two adjacent large droplet ejection outlets 3 connected by the flow passage, an ink droplet is ejected from the other large droplet ejection outlet 3 with a time difference.

(b) Depending on print data, a time from ejection of an ink droplet from one of the two adjacent large droplet ejection outlets 3 connected by the flow passage to ejection of an ink droplet from the other large droplet ejection outlet 3 is changed.

With respect to the type (a), an effect of alleviating a crosstalk-like phenomenon between the connected large droplet ejection outlets 3 by deviating (shifting) ejection timings of the ink droplets ejected from the connected large droplet ejection outlets 3 from each other is achieved. When the number of the plurality of large droplet ejection outlets 3 connected by the large droplet flow passages 5 (and the sub-flow passages 7) is taken as n and a time required for ejecting ink droplets from all of the connected plurality of large droplet ejection outlets 3 is taken as t, the time difference of the ejection timings may preferably be approximately t/n. In an optimum embodiment, an ink refilling operation with respect to one of the connected (adjacent two) large droplet ejection outlets 3 is completed after an ink droplet is ejected from this large droplet ejection outlet 3, and thereafter an ink droplet is ejected from the other large droplet ejection outlet 3. However, in this case, a time from ejection of ink droplets from all the large droplet ejection outlets 3 until the ink refilling operation is completed is prolonged, so that it is preferable that a drive time difference between the connected large droplet ejection outlets 3 is decreased within such a range that the crosstalk-like phenomenon presents no problem.

With respect to the type (b), escape of bubble generating power of the case of ejecting ink droplets from both of the connected large droplet ejection outlets 3 at the same time is smaller than that of the case of ejecting the ink droplets only from one of the connected large droplet ejection outlets 3. Therefore, ejection energy imparted to the ink droplets can be increased, so that it is possible to increase an ejection amount. In other words, by changing the ejection timing from the connected large droplet ejection outlets 3, it is possible to modulate the ejection amount.

As described above, according to the present invention, even in the case where the distance (OH) is decreased in order to properly retain the ejection performance from the small droplet ejection outlets while decreasing an ejection amount from the small droplet ejection outlets, the ejection frequency upper limit of the large droplet ejection outlets can be kept at a high level and it is possible to satisfactorily keep the symmetry of the ink flow passage. As a result, a high throughput and a good ejection state can be maintained. Further, the above-described effects can be realized simply and inexpensively with accuracy.

Embodiment 2

Figure 2:
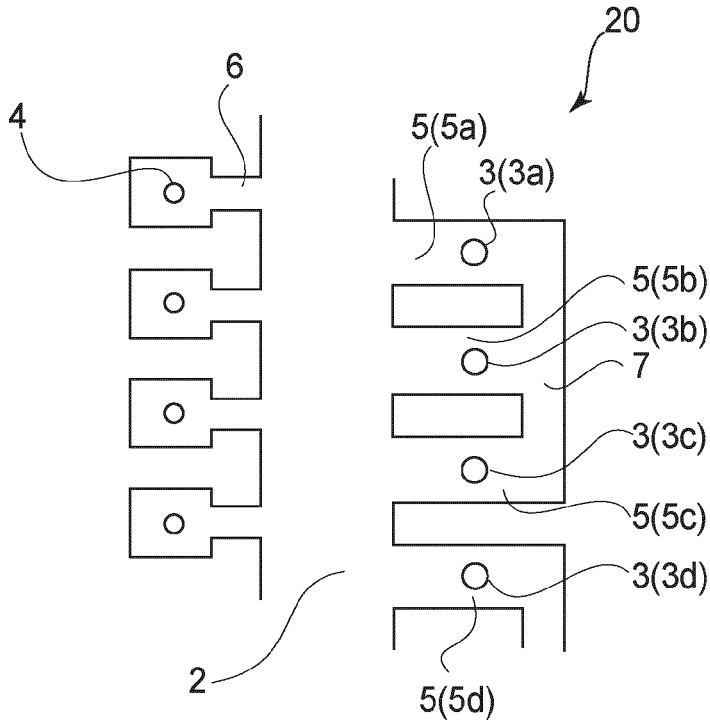
FIGS. 2 to 9 are schematic plan views each showing other embodiments of the ink jet recording head of the present invention.

Another Embodiment of the ink jet recording head of the present invention will be described. FIG. 2 is a partially enlarged schematic plan view showing ejection outlets, flow passages and a common liquid chamber in an ink jet recording head 20 in this embodiment.

A base constitution of the recording head 20 in this embodiment is in common with the recording head 10 in Embodiment 1. Therefore, the common constitution is omitted from the following description by using identical reference numerals. The recording head 20 in this embodiment is characterized in that three large droplet flow passages 5 are connected. More specifically, a large droplet flow passage 5*a* provided for a large droplet ejection outlet 3*a*, a large droplet flow passage 5*b* provided for a large droplet ejection outlet 3*b*, and a large droplet flow passage 5*c* provided for a large droplet ejection outlet 3*c* are connected with each other by a sub-flow passage 7. In other words, with respect to one large droplet ejection outlet 3, the three large droplet flow passages 5 and the sub-flow passage 7 connecting these large droplet flow passages 5 function as a flow passage for supplying ink. The above-described structure is similar to those with respect to other large droplet ejection outlets. For example, a large droplet flow passage 5*d* provided for a large droplet ejection outlet 3*d* and two adjacent large droplet flow passages (not shown) provided for two large droplet ejection outlets (not shown) are connected with each other by a sub-flow passage (not shown).

In this embodiment, the recording head 20 having the above-described features has an advantage of increasing in ejection amount modulation range, compared with the recording head 10 in Embodiment 1, by changing a time difference of ejection from each of the large droplet ejection outlets 3.

Further, when the ink droplets are ejected from each large droplet ejection outlet 3 alone, the number of the flow passages is three, so that escape of bubble generating power is large. As a result, an ejection amount is small. On the other hand, when the ink droplets are ejected from the three large droplet ejection outlets 3 provided with the connected three large droplet flow passages 5 at the same time, the escape of bubble generating power is decreased, so that the ejection amount is increased. Further, the ink droplets can be ejected from any two large droplet ejection outlets 3.

Embodiment 3

Figure 3:
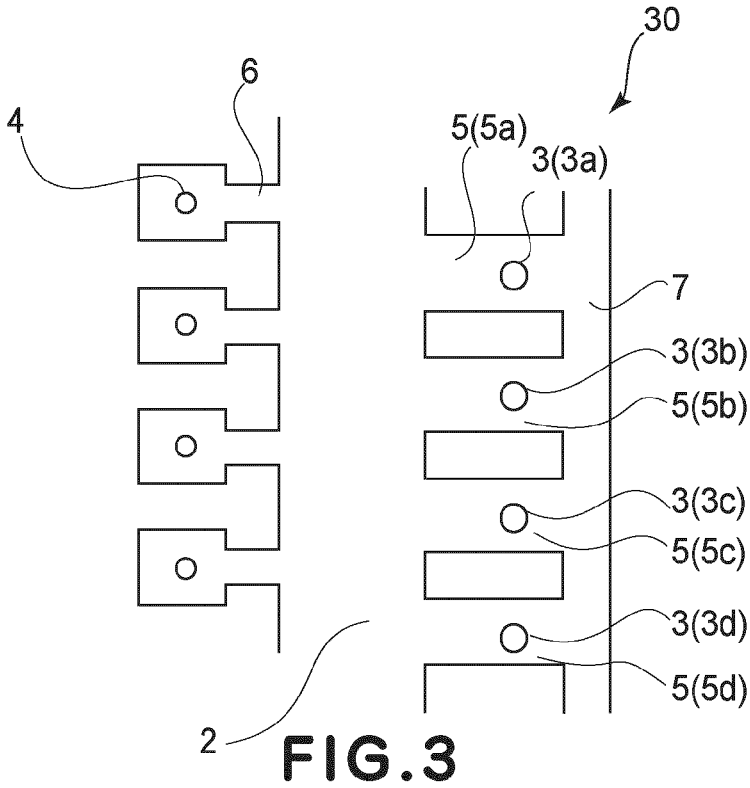

Another Embodiment of the ink jet recording head of the present invention will be described. FIG. 3 is a partially enlarged schematic plan view showing ejection outlets, flow passages and a common liquid chamber in an ink jet recording head 30 in this embodiment.

A base constitution of the recording head 30 in this embodiment is in common with the recording head 10 in Embodiment 1. Therefore, the common constitution is omitted from the following description by using identical reference numerals. The recording head 30 in this embodiment is characterized in that all the plurality of large droplet flow passages 5 are connected. In FIG. 3, only large droplet flow passages 5*a* to 5*d* are shown, but other large droplet flow passages are also connected by a single sub flow passage 7. In other words, in this embodiment, all of large droplet ejection outlets 3 are connected each to other through the flow passages 5 and 7.

The large droplet ejection outlets 3 in the recording head 10 shown in FIG. 1 and the recording head 20 shown in FIG. 2 have asymmetry with respect to an arrangement direction thereof except for the central large droplet ejection outlet 3 of the three large droplet ejection outlets 3 in the recording head 20 (e.g., the large droplet ejection outlet 3*b* shown in FIG. 2). Accordingly, there is possibility of such an influence that an ejection direction of the ink droplet is inclined. On the other hand, the recording head 30 in this embodiment has complete symmetry of all the large droplet ejection outlets 3 with respect to an arrangement direction of the large droplet ejection outlets 3.

Embodiment 4

Figure 4:
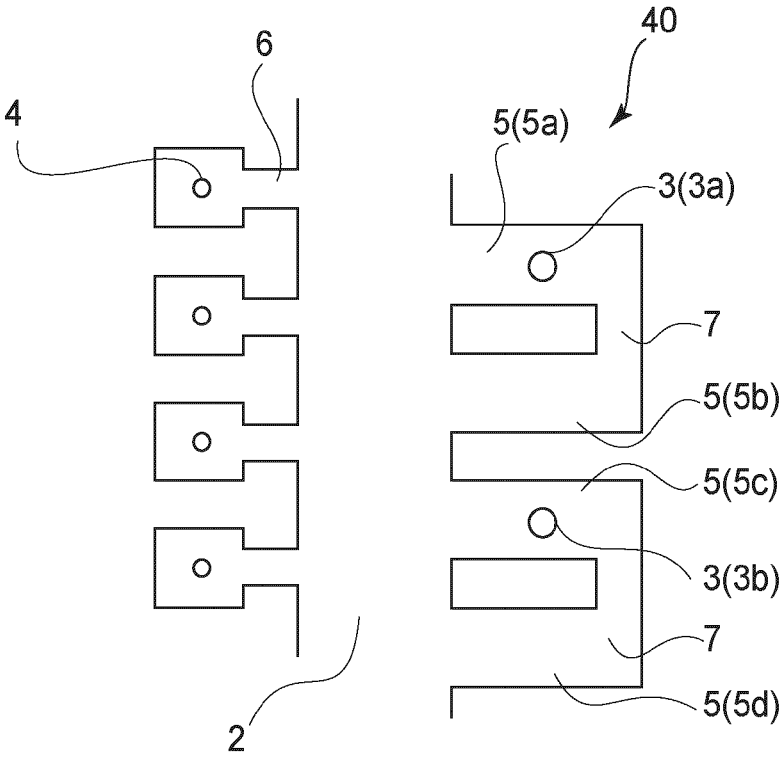

Another Embodiment of the ink jet recording head of the present invention will be described. FIG. 4 is a partially enlarged schematic plan view showing ejection outlets, flow passages and a common liquid chamber in an ink jet recording head 40 in this embodiment.

A base constitution of the recording head 40 in this embodiment is in common with the recording head 10 in Embodiment 1. Therefore, the common constitution is omitted from the following description by using identical reference numerals. In the recording head 40 in this embodiment, the large droplet ejection outlet 3*b* which is provided on the large droplet flow passage 5*b* in the recording head 10 is provided on the large droplet flow passage 5*c*.

In other words, in the recording head 40 in this embodiment, on one of two large droplet flow passages 5 connected through the sub-flow passage 7, one large droplet ejection outlet 3 is provided. Accordingly, the recording head 40 is in common with the recording head 10 in that the two large droplet flow passages 5 and the sub-flow passage 7 connecting these flow passages function as an ink supply passage for the one large droplet ejection outlet 3. More specifically, referring to FIG. 4, with respect to the large droplet ejection outlet 3*a* provided on the large droplet flow passage 5*a*, the large droplet flow passages 5*a* and 5*b* and the sub-flow passage 7 connecting these passages function as the ink supply passage. Further, with respect to the large droplet ejection outlet 3*b* provided on the large droplet flow passage 5*c*, the large droplet flow passages 5*c* and 5*d* and the sub-flow passage 7 connecting these passages function as the ink supply passage.

However, in the recording head 10 shown in FIG. 1, two adjacent large droplet ejection outlets 3 are connected with each other through not only the common liquid chamber 2, but also the two large droplet flow passages 5 and the sub-flow passage 7, whereas in the recording head 40 in this embodiment, the two adjacent large droplet ejection outlet 3 are connected with each other through only the common liquid chamber 2.

In the recording head 40 in this embodiment, the large droplet ejection outlets 3 are independent from each other, so that the recording head 40 has such an advantage that there is substantially no crosstalk-like phenomenon.

Embodiment 5

Figure 5:
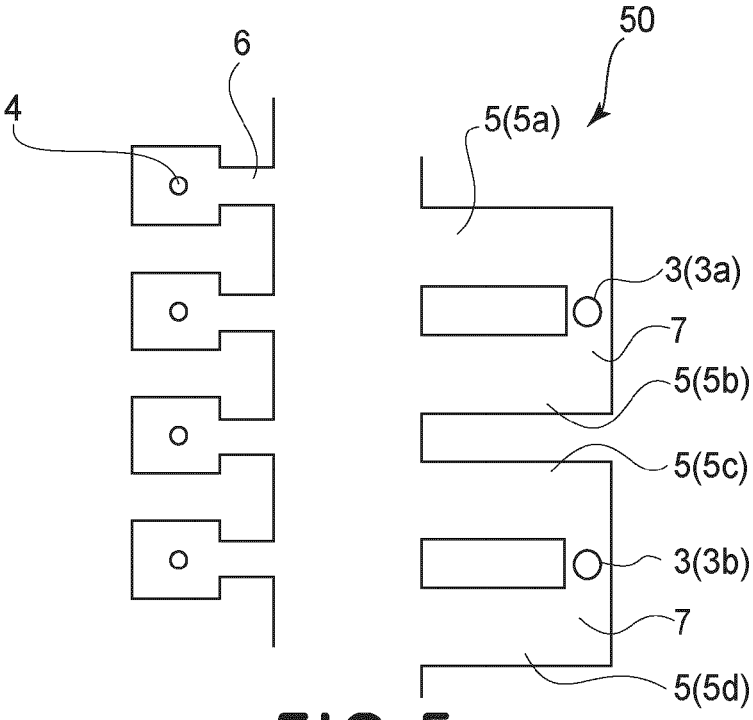

Another Embodiment of the ink jet recording head of the present invention will be described. FIG. 5 is a partially enlarged schematic plan view showing ejection outlets, flow passages and a common liquid chamber in an ink jet recording head 50 in this embodiment.

A base constitution of the recording head 50 in this embodiment is in common with the recording head 40 in Embodiment 4. A different point is that in this embodiment, the large droplet ejection outlets 3 are provided on the sub-flow passage 7 connecting the two large droplet flow passages 5. In other words, each of the large droplet ejection outlets 3 is provided at a central portion of the ink supply passage therefor. More specifically, referring to FIG. 5, the large droplet ejection outlet 3*a* is provided on the sub flow passage 7 connecting the large droplet flow passages 5*a* and 5*b*. Further, the large droplet ejection outlet 3*b* is provided on the sub flow passage 7 connecting the large droplet flow passages 5*c* and 5*d*. Similarly, each of other large droplet ejection outlets (not shown) is provided on an associated sub flow passage connecting two large droplet flow passages.

In the recording head 50 in this embodiment, all the large droplet ejection outlets 3 are completely symmetrical with respect to an arrangement direction thereof, so that the recording head 50 has an advantage that there is less possibility of such an influence that the ejection direction of the ink droplet is inclined.

Embodiment 6

Figure 6:
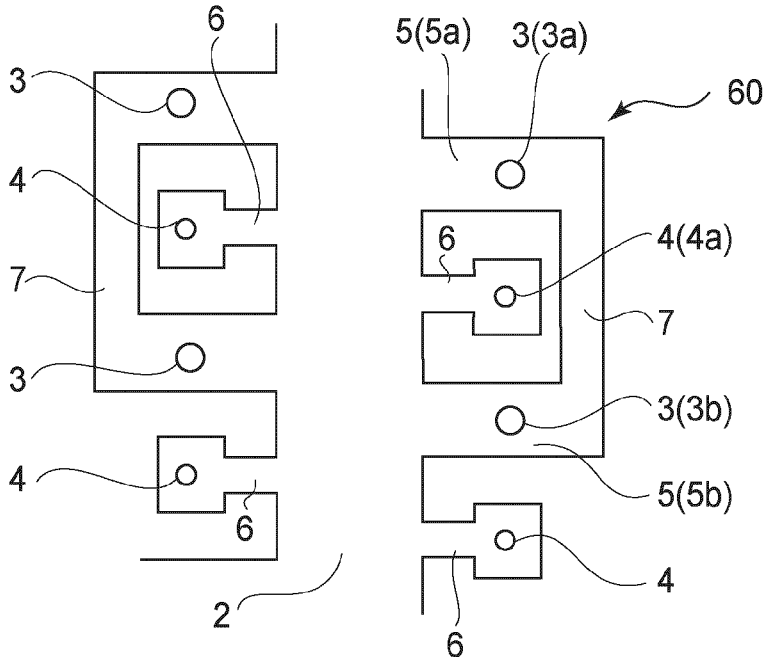

Another Embodiment of the ink jet recording head of the present invention will be described. FIG. 6 is a partially enlarged schematic plan view showing ejection outlets, flow passages and a common liquid chamber in an ink jet recording head 60 in this embodiment.

In the recording head 60 in this embodiment, at both sides of the common liquid chamber 2, the large droplet ejection outlets 3 and the small droplet ejection outlets 4 are alternately arranged. Two large droplet flow passages 5 for supplying the ink to a pair of large droplet ejection outlets 3 disposed adjacent to each other while sandwiching a small droplet ejection outlet 4 are connected with each other through a sub-flow passage 7 at one side of the common liquid chamber 2. Further, the sub-flow passage 7 connects the two large droplet flow passages with each other at a side opposite (remote) from the common liquid chamber 2 with respect to the small droplet ejection outlet 4 located between the sub-flow passage 7 and the common liquid chamber 2.

More specifically, referring to FIG. 6, the large droplet flow passages 5*a* and 5*b* for supplying the ink to the pair of large droplet ejection outlets 3*a* and 3*b* which are disposed adjacent to each other while sandwiching the small droplet ejection outlet 4 therebetween are connected with each other by the sub-flow passage 7 provided at a side opposite from the common liquid chamber 2 while sandwiching the small droplet ejection outlet 4 between the sub-flow passage 7 and the common liquid chamber 2. As a result, the ink supply passage consisting of the two large droplet flow passages 5*a* and 5*b* and the sub-flow passage 7 is formed in a U-shape so as to surround the small droplet ejection outlet 4*a*. In the recording head 60 in this embodiment, an influence of bubble generation at the large droplet ejection outlet 3 is dispersed into a plurality of flow passages in the constitution in which the large droplet ejection outlets 3 and the small droplet ejection outlets 4 are alternately arranged at both sides of the common liquid chamber 2, so that the recording head 60 has such an advantage that the influence on an adjacent small droplet ejection outlet 4 is diminished.

Embodiment 7

Figure 7:
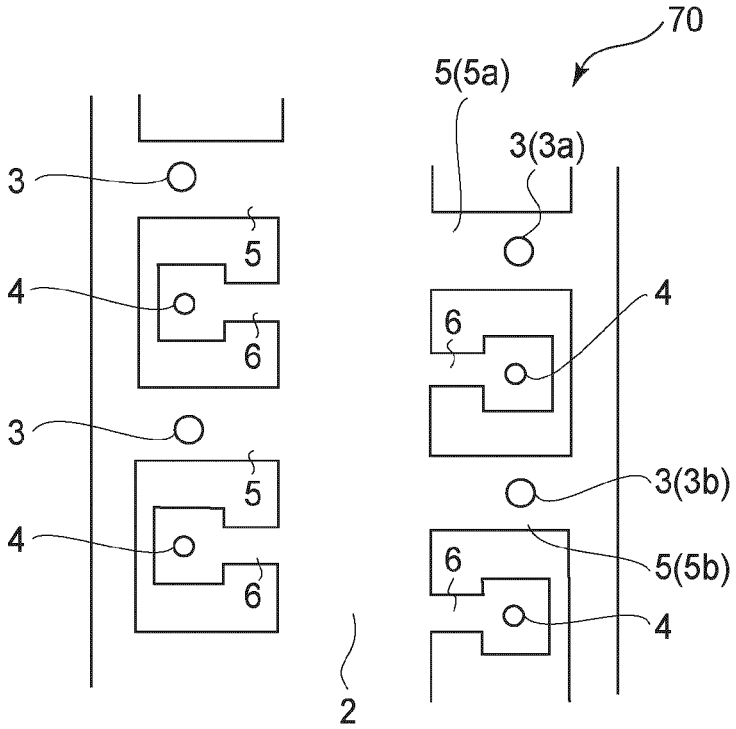

Another Embodiment of the ink jet recording head of the present invention will be described. FIG. 7 is a partially enlarged schematic plan view showing ejection outlets, flow passages and a common liquid chamber in an ink jet recording head 70 in this embodiment.

In the recording head 70 in this embodiment, the sub-flow passages 7 provided on both sides of the common liquid chamber 2 in the recording head 6 shown in FIG. 6 are connected with each other on each side so that all the large droplet ejection outlets 3 are connected with each other.

In the recording head 70 in this embodiment, all the large droplet ejection outlets 3 are completely symmetrical with respect to an arrangement direction thereof, so that the recording head 70 has an advantage that there is less possibility of such an influence that the ejection direction of the ink droplet is inclined.

Embodiment 8

Figure 8:
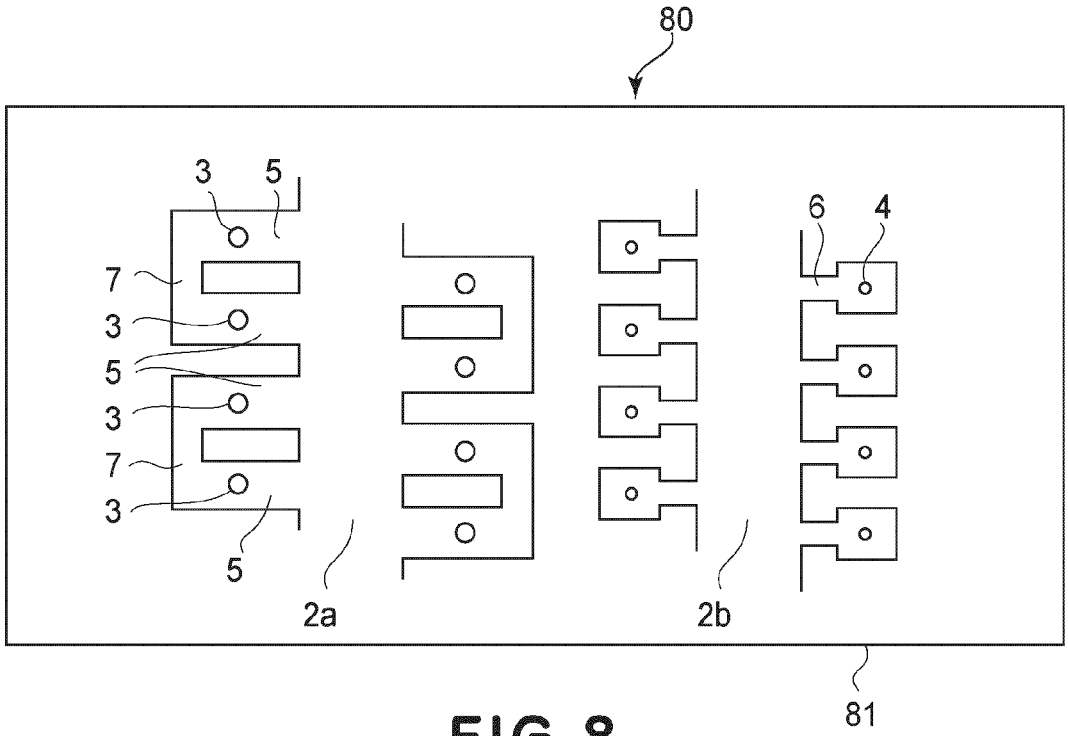

Another Embodiment of the ink jet recording head of the present invention will be described. FIG. 8 is a partially enlarged schematic plan view showing ejection outlets, flow passages and a common liquid chamber in an ink jet recording head 80 in this embodiment.

In the recording head 80 in this embodiment, two common liquid chambers 2*a* and 2*b* are provided on a single substrate 81. At both sides of one of the common liquid chambers (the common liquid chamber 2*a* in this case), only the large droplet ejection outlets are arranged and at both sides of the other common liquid chamber 2*b*, only the small droplet ejection outlets 4 are arranged.

Each of the large droplet ejection outlets 3 communicates with the common liquid chamber 2*a* through the large droplet flow passage 5. Further, two large droplet flow passages 5 causing a pair of large droplet ejection outlets to communicate with the common liquid chamber 2 are connected with each other by the sub-flow passage 7.

On the other hand, each of the small droplet ejection outlets 4 communicate with the common liquid chamber 2*b* through an independent small droplet flow passage 6.

The recording head 80 in this embodiment has such an advantage that the large droplet and the small droplet can be used for different colors.

Embodiment 9

Figure 9:
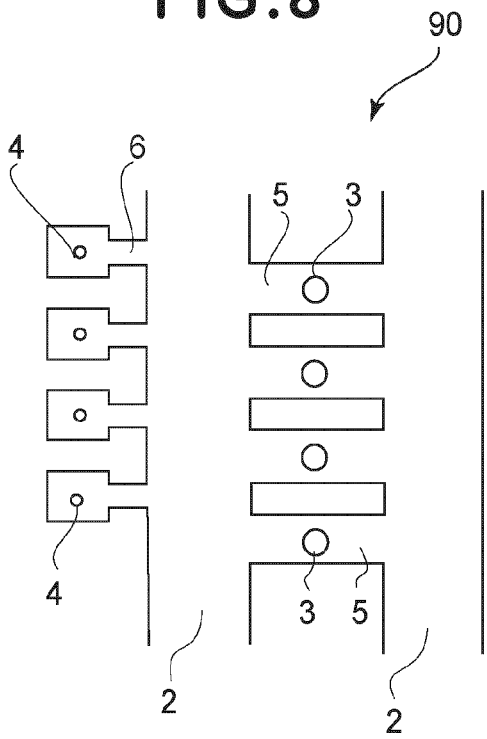
Figure 10:
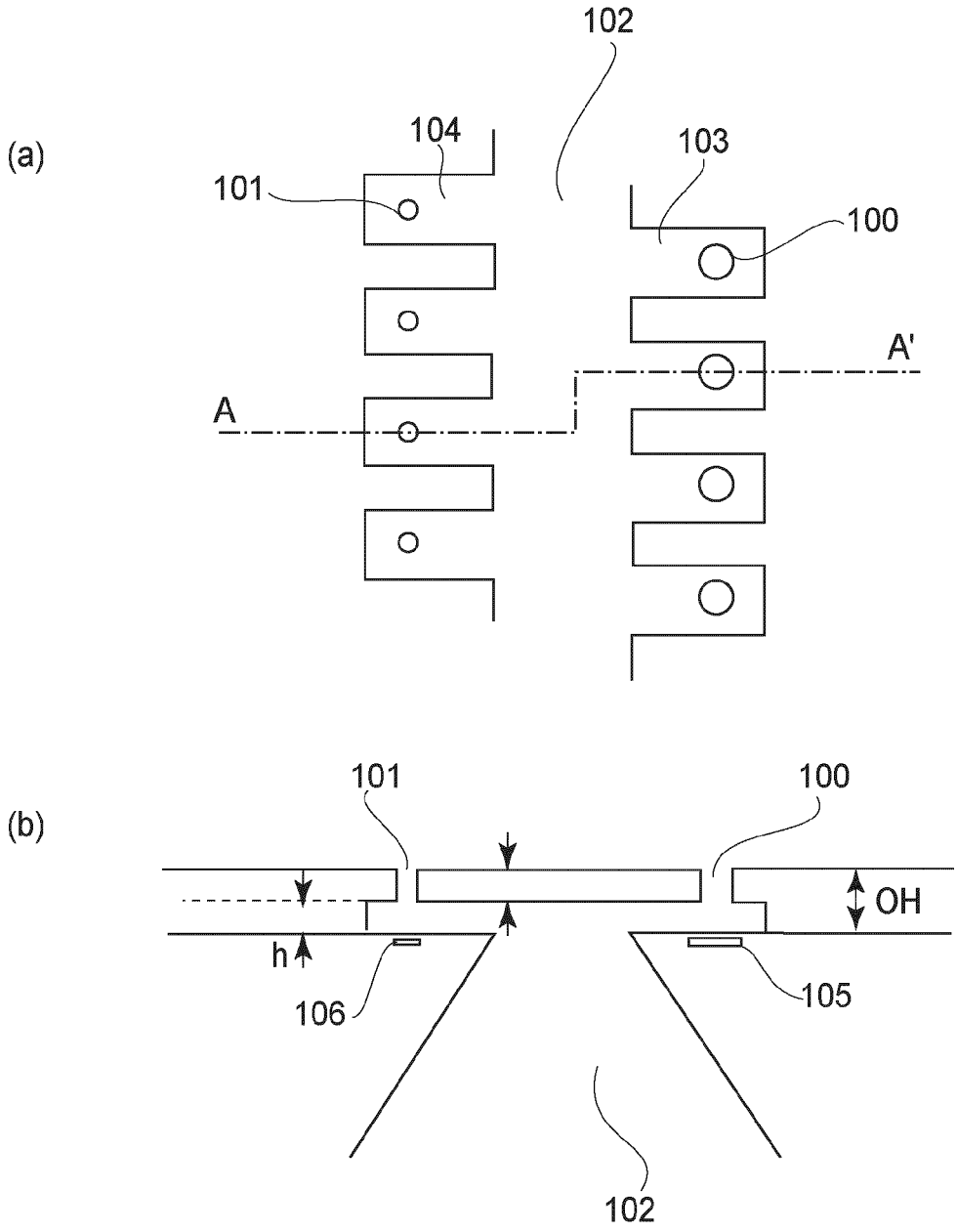
FIGS. 10(*a*), 11(*a*), 12(*a*) and 13(*a*) are schematic plan views each showing an embodiment of a conventional ink jet recording head.
Figure 11:
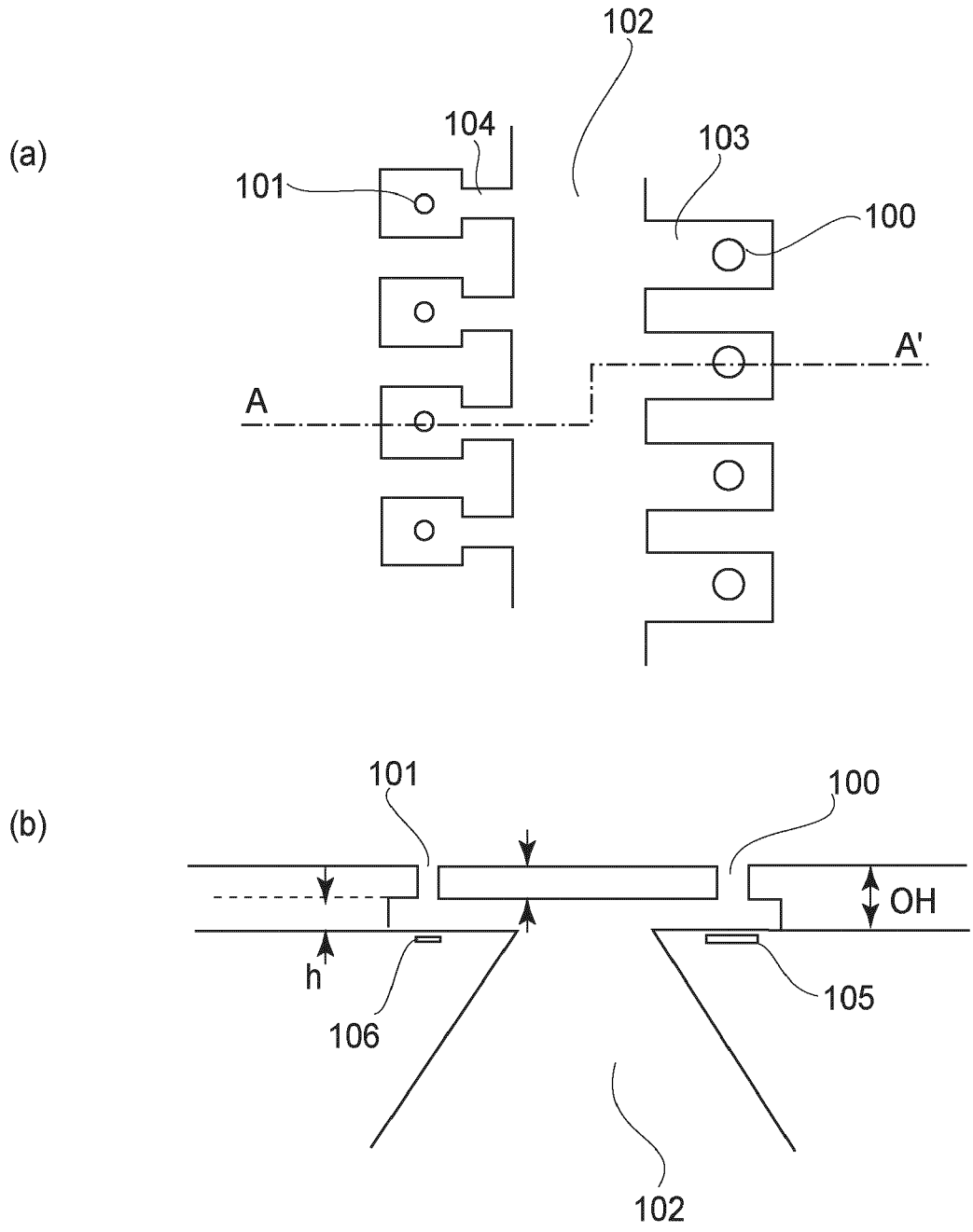
Figure 12:
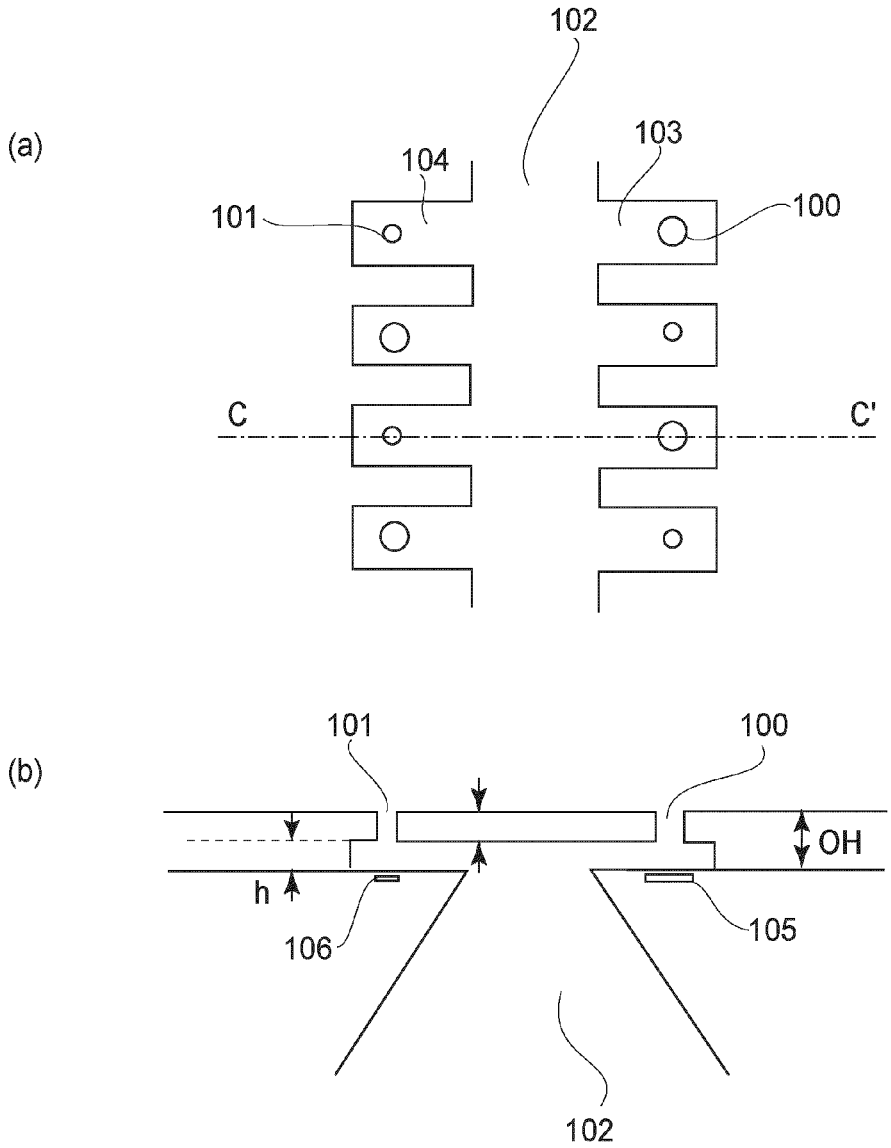
Figure 13:
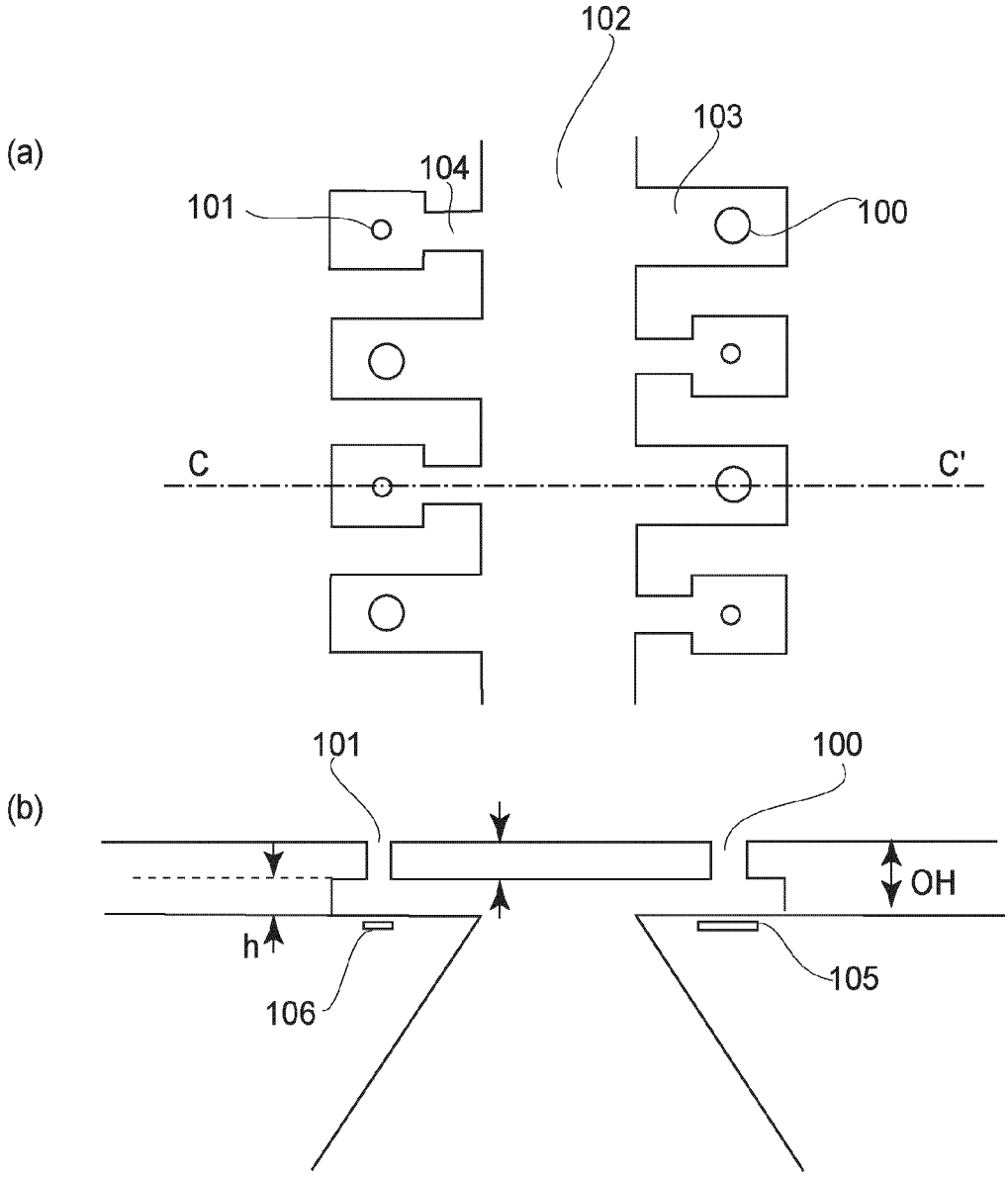

Another Embodiment of the ink jet recording head of the present invention will be described. FIG. 9 is a partially enlarged schematic plan view showing ejection outlets, flow passages and a common liquid chamber in an ink jet recording head 90 in this embodiment.

In the recording head 90 in this embodiment, two large droplet flow passages 5 which are symmetrical with respect to a large droplet ejection outlet 3 are provided. Further, on the same substrate, a plurality of common liquid chambers 2 is provided. To one of the common liquid chambers 2, one of a pair of large droplet flow passages 5 and a small droplet flow passage 6 are connected, and to the other common liquid chamber 2, the other large droplet flow passage 5 is connected.

In the recording head 90 in this embodiment, deposition of a dew-like ink in the neighborhood of the ejection outlets 3 is prevented by symmetrical two large droplet flow passages 5. As a result, it is possible to obviate inconveniences such that the ejection direction of the ink droplet is deviated from a predetermined direction and that a main droplet is not normally formed to fail in normal dot printing. Further, the pair of two large droplet flow passages 5 is connected with different common liquid chambers, so that the recording head 90 has a preferable structure for preventing the crosstalk-like phenomenon.

The present invention is also applicable to appropriate combinations of the above-described embodiments.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 329379/2006 filed Dec. 6, 2006, which is hereby incorporated by reference herein.

What is claimed is:

1. A liquid recording head for effecting recording by ejecting droplets from a plurality of ejection outlets formed on a substrate, said liquid recording head comprising:

a plurality of first ejection outlets each for ejecting a droplet in a relatively large ejection amount;

a plurality of second ejection outlets each for ejecting a droplet in a relatively small ejection amount;

energy generating elements for generating energy for ejecting the droplets from said plurality of first ejection outlets and said plurality of second ejection outlets;

liquid chambers for retaining liquid to be ejected from said plurality of first ejection outlets and said plurality of second ejection outlets;

first flow passages for establishing communication between at least one of said liquid chambers and each of said plurality of first ejection outlets; and second flow passages for establishing communication between at least one of said liquid chambers and each of said plurality of second ejection outlets, wherein said first flow passages form pairs, each pair symmetrically provided with respect to one of said plurality of first ejection outlets, one of each pair of said first flow passages and said second flow passages being connected with one of said liquid chambers and the other one of each pair of said first flow passages being connected with a different one of said liquid chambers.

* * * * *